US010206465B2

(12) United States Patent
Villard et al.

(10) Patent No.: US 10,206,465 B2
(45) Date of Patent: Feb. 19, 2019

(54) TIMEPIECE OR PIECE OF JEWELLERY MADE OF A LIGHT PRECIOUS ALLOY CONTAINING TITANIUM

(71) Applicant: Montres Breguet S.A., L'Abbaye (CH)

(72) Inventors: Gaetan Villard, Cossonay (CH); Denis Vincent, Neuchatel (CH); Stephane Lauper, Cortaillod (CH)

(73) Assignee: Montres Breguet S.A., L'Abbaye (CH)

( * ) Notice: Subject to any disclaimer, the term of this patent is extended or adjusted under 35 U.S.C. 154(b) by 60 days.

(21) Appl. No.: 15/533,471

(22) PCT Filed: Dec. 17, 2015

(86) PCT No.: PCT/EP2015/080211
§ 371 (c)(1),
(2) Date: Jun. 6, 2017

(87) PCT Pub. No.: WO2016/107752
PCT Pub. Date: Jul. 7, 2016

(65) Prior Publication Data

US 2017/0367446 A1 Dec. 28, 2017

(30) Foreign Application Priority Data

Dec. 29, 2014 (EP) ..... 14200381

(51) Int. Cl.
*C22C 5/04* (2006.01)
*A44C 27/00* (2006.01)
(Continued)

(52) U.S. Cl.
CPC ..... *A44C 27/003* (2013.01); *A44C 5/00* (2013.01); *C22C 5/02* (2013.01); *C22C 5/04* (2013.01);
(Continued)

(58) Field of Classification Search
CPC ..... C22C 5/04; C22C 14/00; A44C 27/003; A44C 27/006; G04B 37/22; G04B 37/221;
(Continued)

(56) References Cited

U.S. PATENT DOCUMENTS 4,759,906 A 7/1988 Nenno et al.

FOREIGN PATENT DOCUMENTS

| | | |
|---|---|---|
| EP | 0 239 747 A1 | 10/1987 |
| EP | 0 267 318 A2 | 5/1988 |
| GB | 876887 A | 9/1961 |

OTHER PUBLICATIONS

International Search Report dated May 18, 2016 in PCT/EP2015/080211 filed Dec. 17, 2015.

*Primary Examiner* — Scott R Kastler
*Assistant Examiner* — Vanessa T. Luk
(74) *Attorney, Agent, or Firm* — Oblon, McClelland, Maier & Neustadt, L.L.P.

(57) ABSTRACT

An external component for timepieces or pieces of jewelry, made of a light precious alloy containing titanium and palladium, according to the atomic formula $Ti_aPd_bM_cT_d$, where a, b, c, d are atomic fractions of the total, such that a+b+c+d=1. a is 0.44 to 0.55, b is 0.30 to 0.45, c is 0.04 to 0.24, and d is 0.001 to 0.03. The alloy includes at most two metals M, taken from among Nb, V, Fe, Co, Au, Pt. Each metal trace T has an atomic percentage of less than 3.00% of the total alloy, from among Nb, V, Mo, Ta, W, Fe, Co, Ni, Ru, Rh, Ir, Au, Pt, Cr, Mn, Cu, Zn, Ag, Al, B, Si, Ge, Sn, Sb, and In. The alloy contains at least 0.05% of boron, and contains at least 50% by mass of palladium.

15 Claims, 1 Drawing Sheet

(51) Int. Cl.

| | |
|---|---|
| ***C22C 30/00*** | (2006.01) |
| ***C22C 30/02*** | (2006.01) |
| ***G04B 37/22*** | (2006.01) |
| ***G04B 45/00*** | (2006.01) |
| ***A44C 5/00*** | (2006.01) |
| ***C22C 5/02*** | (2006.01) |
| ***C22C 14/00*** | (2006.01) |

(52) U.S. Cl.
CPC ..... *C22C 14/00* (2013.01); *C22C 30/00* (2013.01); *C22C 30/02* (2013.01); *G04B 37/22* (2013.01); *G04B 45/0076* (2013.01)

(58) Field of Classification Search
CPC .. G04B 37/223; G04B 37/225; G04B 37/226; G04B 37/228; G04B 45/0076
See application file for complete search history.

TIMEPIECE OR PIECE OF JEWELLERY MADE OF A LIGHT PRECIOUS ALLOY CONTAINING TITANIUM

CROSS REFERENCE TO RELATED APPLICATIONS

The present application is a 35 U.S.C. § 371 national stage patent application of International patent application PCT/EP2015/080211, filed on Dec. 17, 2015, published as WO 2016/107752 on Jul. 7, 2016, the text of which is incorporated by reference, and claims the benefit of the filing date of European application no. 14200381.3, filed on Dec. 29, 2014, the text of which is also incorporated by reference.

FIELD OF THE INVENTION

The invention concerns an external component for a timepiece or piece of jewelry made of a light, precious alloy containing titanium.

The invention also concerns a timepiece or piece of jewelry including at least one such external component.

The invention concerns the field of external components for timepieces, and pieces of jewelry.

BACKGROUND OF THE INVENTION

A common feature of most precious alloys used in watchmaking is their relatively high density (>10 g/cm$^3$). In fact, the two main precious metals used in horology, namely gold and platinum, have respective densities of around 19.3 and 21.5 g/cm$^3$. Consequently, this makes their alloys relatively heavy. Silver and palladium are lighter (10.5 and 12 g/cm$^3$ respectively), but much less used in horology.

Moreover, the use of light metals like titanium and, to a lesser extent, aluminium, in external watch parts, is relatively widespread. However, currently, few alloys can be considered to be both precious (i.e. meet fineness requirements) and light.

WO Patent Application 2012/119647A1 describes ceramic/precious metal compounds able to achieve relatively low densities (<8 g/cm$^3$).

It is not generally possible to obtain ductile metals by creating alloys from light metals and precious metals, and in almost all cases this results in brittle intermediate phases.

However, there is an exception for equiatomic Ti(Pd/Pt/Au) phases. Indeed, these phases may resemble the equiatomic TiNi phase used in some shape memory alloys. Likewise, equiatomic TiPd, TiPt and TiAu phases have some ductility and may, in certain conditions, exhibit behaviour typical of TiNi shape memory alloys. Equiatomic TiPd, TiPt and TiAu alloys have been known for a long time and have been the subject of several studies aimed at high temperature shape memory alloys.

The effect of adding alloying elements other than Ni, Pd, Pt, Au to these systems has mainly been studied for TiNi alloys. Research concerning ternary additions to TiPd, TiPt and TiAu alloys are substantially less common. It is known, however, that adding iron to a TiPd system has an effect on the system's phase transformations.

Most of the literature concerning additions to binary equiatomic alloys of TiNi, TiPd, TiPt and TiAu focuses on modification of the shape memory properties and so-called super-elastic properties of these alloys (amplitude, transition temperature). However, there is no study on the issue of using such alloys in jewelry/horology and the associated constraints, namely shapeability and fineness (percentage of precious metal).

The mass compositions of the ductile equiatomic phases of alloys of TiPd, TiPt and TiAu are shown in Table 1, which sets out the composition of the equiatomic Ti—(Pd, Pt, Au) phases and a comparison to the legal fineness standards applicable in Switzerland.

| Alloy | Atomic composition | Approx. mass composition | Legal fineness of precious metals in Switzerland | Fineness lower than the equiatomic composition |
|---|---|---|---|---|
| TiPd | $Ti_{50}Pd_{50}$ | $Ti_{310}Pd_{690}$ | 999, 950, 500 | 500 |
| TiPt | $Ti_{50}Pt_{50}$ | $Ti_{197}Pt_{803}$ | 999, 900, 850 | — |
| TiAu | $Ti_{50}Au_{50}$ | $Ti_{196}Au_{804}$ | 999, 750, 585, 375 | 750, 585, 375 |

It is noted that the TiPd and TiAu alloys meet fineness requirements and are therefore of interest for horology and jewelry, as particularly light precious metals.

EP Patent document 0267318 in the name of HAFNER cites certain palladium alloys: 25 to 50% by mass of palladium, with 37 to 69% of silver, and a complement of copper, zinc, gallium, cobalt, indium, tin, iron, aluminium, nickel, germanium, rhenium, but without titanium, and other alloys, from 51 to 95% of palladium, with the addition of different metals, of which only one alloy contains gold, with 70% by mass of palladium, 15% of silver, 5% of copper, 5% of zinc, 3% of platinum, 2% of gold. The only composition disclosed with titanium, of the $Ti_5Pd_{95}$ type, concerns an alloy with 5% titanium, and 95% palladium.

EP Patent document 0239747 in the name of SUMIMOTO describes the addition of 0.001 to 20% of chromium to a titanium-palladium type alloy with 40 to 60 atomic percent of titanium, and the complement of palladium. Seven alloys are disclosed with 50 atomic percent of titanium, with 40 to 50 atomic percent of palladium, and 0 to 10 atomic percent of chromium: $Ti_{50}Pd_{40}$, $Ti_{50}Pd_{45}C_{r5}$, $Ti_{50}Pd_{43}Cr_7$, $Ti_{50}Pd_{42}Cr_8$, $Ti_{50}Pd_{41.5}Cr_{8.5}$, $Ti_{50}Pd_{41}Cr_9$, $Ti_{50}Pd_{40}Cr_{10}$.

CH Patent document 704233 in the name of RICHEMONT describes the use in horology of titanium alloys, of the Ti-10-2-3 type including vanadium, iron and aluminium, of the Ti13-11-3 type containing vanadium, chromium and aluminium, of the Ti-15-3 type containing vanadium, chromium, aluminium and tin, of the Ti-5-5-5-3 type containing aluminium, vanadium, molybdenum and chromium. These alloys do not contain either palladium or gold.

SUMMARY OF THE INVENTION

The invention proposes to produce external timepiece components, which are at once precious, to benefit from fineness and resistance to wear. and corrosion, and lighter than known alloys.

To this end, the invention concerns an external component for a timepiece or piece of jewelry according to claim 1.

The invention also concerns a timepiece or piece of jewelry including at least one such external component.

BRIEF DESCRIPTION OF THE DRAWINGS

Other features and advantages of the invention will appear upon reading the following detailed description, with reference to the annexed drawings, in which.

in a broken line $Ti_{50}Pd_{35.5}Nb_{14.5}$, in a continuous line $Ti_{50}Pd_{32}Fe_{18}$, in a dotted $Ti_{44.5}Pd_{35}Nb_{11}Fe_{9.5}$ in a dot and dash line $Ti_{50}Pd_{50}$.

Figure 2:
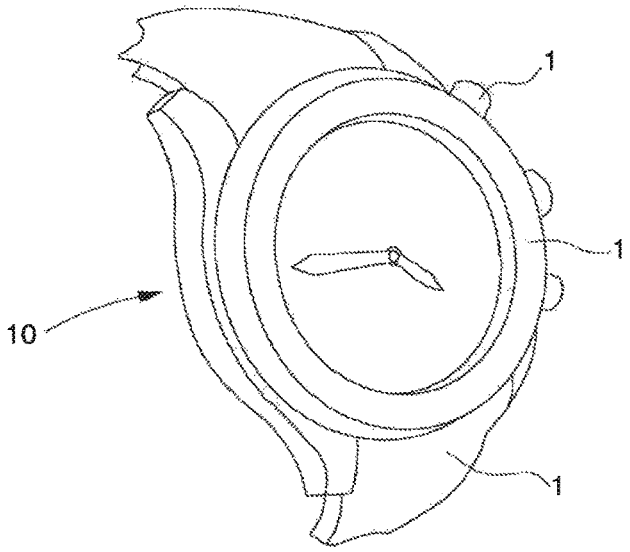

FIG. 2 represents a watch comprising a case and a bracelet according to the invention.

DETAILED DESCRIPTION OF PREFERRED EMBODIMENTS

All the concentrations expressed in the following description are atomic percentages, unless otherwise specified.

The invention concerns the replacement of gold and palladium in alloys containing titanium.

The invention concerns an external component 1 for a timepiece or piece of jewelry (including gemstone jewelry) made of a light precious alloy containing titanium, and any timepiece or piece of jewelry including such a component.

The invention concerns two families of alloys, described one after the other. The first family of alloys comprises nine model compositions (first to ninth), utilising five groups of metals (first to seventh) and some of their sub-groups.

The use of alloys, such as those described above in Table 1, which contain more precious metal than required for the fineness hallmark which they may bear, results in unnecessary extra cost. To overcome this problem, advantageous substitutes may be suitable for the extra precious metal, and particularly metals from a second group including: Fe, Co, Ni, Ru, Rh, Ir, Au, Pt, Nb, V, Mo, Ta, W.

Figure 1:
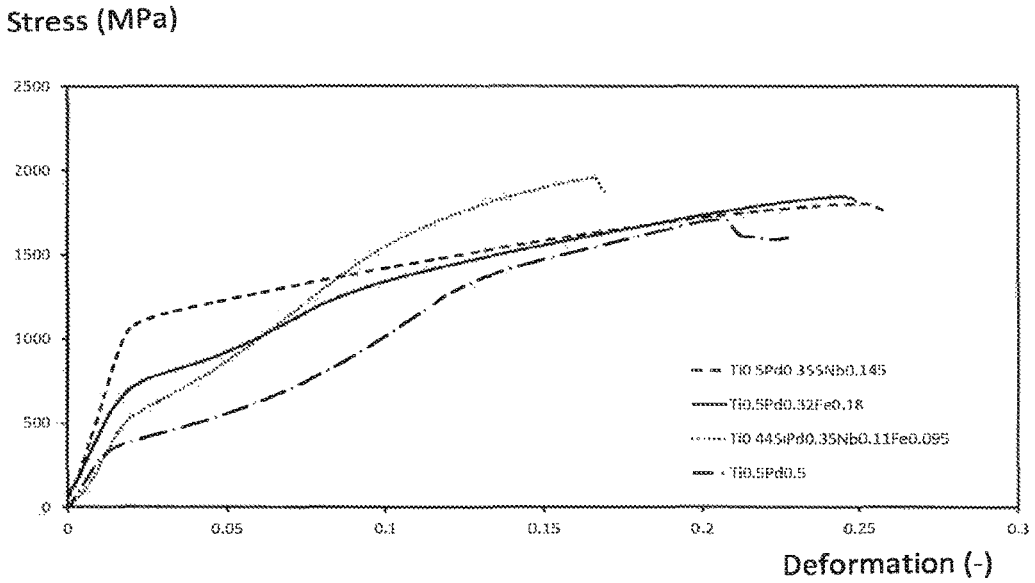
FIG. 1 compares the stress deformation curves of alloys tested in compression with a speed of deformation of 0.001/s.

These elements may be added in large quantities (>10 atomic percent) to TiPd and TiAu alloys as a replacement for palladium and gold respectively. For example, the ductility in compression of the alloys $Ti_{50}Pd_{35.5}Nb_{14.5}$, $Ti_{50}Pd_{32}Fe_{18}$ and $Ti_{44.5}Pd_{35}Nb_{11}Fe_{9.5}$ (at. %) is not significantly different from that of a binary equiatomic TiPd alloy, as seen in FIG. 1, which compares the stress-deformation curves of the alloys $Ti_{50}Pd_{35.5}Nb_{14.5}$, $Ti_{50}Pd_{32}Fe_{18}$, $Ti_{44.5}Pd_{35}Nb_{11}Fe_{9.5}$ and $Ti_{50}Pd_{50}$, tested in compression with a speed of deformation of 0.001/s.

The elements of a third group including: Cr, Mn, Cu, Zn and Ag, may be added in limited quantities (<10 at. %) to TiPd and Au alloys as a replacement for palladium and gold respectively.

Finally, the elements of a fourth group including: Al, Si, Ge, Sn, Sb and In can be added in small quantities (<4 at. %) to TiPd and TiAu alloys as a replacement for titanium or palladium and gold respectively.

Ideally, for applications in contact with human skin, the replacement materials should not cause health risks. To efficiently reduce the extra cost due to the presence of precious metals, the materials replacing the latter should not be precious. Finally, to avoid making the alloy too heavy, the replacement materials are ideally not heavier than the metal being replaced.

A particularly advantageous implementation of the invention concerns the replacement of some of the palladium in a TiPd alloy.

The invention thus concerns a ductile alloy based on the equiatomic intermetallic compound Ti—Pd, in which any surplus palladium with respect to the mass content required for the fineness standard Pd500 is partly or totally replaced by a non-precious element, such that titanium still represents 50 atomic percent of the final alloy. Such an alloy has sufficient ductility to offer shapeability similar to that of conventional titanium alloys.

It is thus a matter of reducing excess fineness, by replacing part of the palladium, with no unfavourable impact on ductility.

The ternary alloys TiPdFe and TiPdNb allow the desired fineness to be achieved. More particularly, TiPdNb alloys have no undesirable shape memory effect, which is advantageous.

The composition of the alloy can be formulated according to one of the following compositions, where all the fractions are atomic fractions:

First Composition:

Part of the titanium is replaced by the same atomic quantity of zirconium or hafnium, since these three elements have very close chemical properties and can easily be substituted for each other.

$$Ti_{a-x}(Zr,Hf)_xM_yPd_{1-a-y}$$

$0.3<a<0.6$; $0<x<0.15$; $0.01<y<0.4$

M=one or more from a first group composed of: Nb, V, Mo, Ta, W, Fe, Co, Ni, Ru, Rh, Ir, Au, Pt, Cr, Mn, Cu, Zn, Ag, Al, Si, Ge, Sn, Sb, In.

a defines the difference with respect to the equiatomic composition.

x defines the degree of replacement of titanium by Zr and Hf.

y defines the fraction of replacement element.

Second Composition:

$$Ti_{a-x}(Zr,Hf)_xM_yPd_{1-a-y}$$

$0.3<a<0.6$; $0<x<0.05$; $0.01<y<0.4$

Restriction of the content of Zr, Hf, with respect to the first composition

Third Composition:

$$Ti_{a-x}(Zr,Hf)_xM_yPd_z$$

$0.3<a<0.6$; $0<x<0.05$; $0.01<y<0.4$; $0.2<z<0.55$

Fourth Composition:

$$Ti_{a-x}(Zr,Hf)_xM_yPd_z$$

$0.44<a<0.55$; $0<x<0.05$; $0.07<y<0.28$; $0.25<z<0.45$

From the fourth composition, the particular compositions that follow are particularly suitable:

| | |
|---|---|
| $Ti_{0.5}Pd_{0.32}Fe_{0.18}$ | a = 0.5, x = 0, y = 0.18, z = 0.32 |
| $Ti_{0.5}Pd_{0.354}Nb_{0.146}$ | a = 0.5, x = 0, y = 0.146, z = 0.354 |
| $Ti_{0.5}Pd_{0.404}Au_{0.09}$ | a = 0.5, x = 0, y = 0.096, z = 0.404 |
| $Ti_{0.5}Pd_{0.323}Co_{0.177}$ | a = 0.5, x = 0, y = 0.177, z = 0.323 |
| $Ti_{0.5}Pd_{0.32}Fe_{0.17}Cr_{0.01}$ | a = 0.5, x = 0, y = 0.18, z = 0.32 |
| $Ti_{0.5}Pd_{0.32}Fe_{0.17}Cu_{0.01}$ | a = 0.5, x = 0, y = 0.18, z = 0.32 |
| $Ti_{0.49}Zr_{0.01}Pd_{0.323}Fe_{0.177}$ | a = 0.5, x = 0.01, y = 0.177, z = 0.323 |
| $Ti_{0.49}Pd_{0.317}Fe_{0.173}Al_{0.02}$ | a = 0.49, x = 0, y = 0.193, z = 0.317 |
| $Ti_{0.445}Pd_{0.35}Nb_{0.11}Fe_{0.095}$ | a = 0.445, x = 0, y = 0.205, z = 0.35 |

Fifth Composition:

Composition according to the fourth composition, wherein M includes one or more elements taken from a fifth group including: Nb, Mo, Fe, Cr, Mn, Cu, Zn, Ag, Al, Si, Ge, Sn, In.

As total replacement for palladium, chromium and copper make the alloy brittle. Manganese, zinc, silver, aluminium, silicon, germanium, indium, tin and molybdenum may, in certain conditions, have a similar effect. Their content must therefore be limited, and iron and niobium are preferred as the main replacement elements.

Sixth Composition:

Composition according to the fifth composition, wherein M includes Fe and/or Nb as major element.

Seventh Composition:

Composition according to the sixth composition, and containing 50% by mass of palladium.

Eighth Composition:

| TiPdFeCr alloys | | | | | | | | | |
|---|---|---|---|---|---|---|---|---|---|
| Atomic | | | | | Mass | | | | |
| Ti | Pd | Fe | Cr | Total | Ti | Pd | Fe | Cr | Total |
| 49.7 | 32 | 15.3 | 3 | 100 | 35.01 | 50.12 | 12.57 | 2.3 | 100 |
| 49.7 | 32 | 12.3 | 6 | 100 | 35.07 | 50.2 | 10.13 | 4.6 | 100 |
| 49.7 | 31.9 | 10.4 | 8 | 100 | 35.14 | 50.14 | 8.58 | 6.14 | 100 |

More particularly, the atomic composition Ti49.7Pd32Fe15.3Cr3 has interesting characteristics: low memory effect, low second phase quantity, and mechanical properties that are not too high.

Ninth Composition:

| TiPdNb alloys | | | | | | | |
|---|---|---|---|---|---|---|---|
| Atomic | | | | Mass | | | |
| Ti | Pd | Nb | Total | Ti | Pd | Nb | Total |
| 49.7 | 37.8 | 12.5 | 100 | 31.46 | 53.18 | 15.36 | 100 |
| 49.7 | 39.8 | 10.5 | 100 | 31.34 | 55.8 | 12.86 | 100 |

The compositions of this ninth composition containing 12.5 and 10.5 at. % of niobium have a shape memory effect, whereas the $Ti_{50}Pd_{35.5}Nb_{14.5}$ composition of FIG. 1 containing 14.5% niobium has no such effect. This composition with 14.5% niobium obviates these effects owing to its biphase nature.

Generally, small discrepancies in composition, particularly concerning that of titanium, on the order of 0.3% of the total, do not fundamentally change the properties of these different compositions, and do not impair their suitability for replacing conventional alloys.

The invention thus concerns an external component for a timepiece or piece of jewelry made of a light, precious alloy containing titanium. According to the first composition set out above, the composition of this alloy conforms to the atomic composition:

$$Ti_{a-x}(Zr,Hf)_xM_yPd_{1-a-y},$$

with $0.3<a<0.6$, $0<x<0.15$, $0.01<y<0.4$, and M being one or more from a first group composed of: Nb, V, Mo, Ta, W, Fe, Co, Ni, Ru, Rh, Ir, Au, Pt, Cr, Mn, Cu, Zn, Ag, Al, Si, Ge, Sn, Sb, In.

More particularly, this alloy includes between 15 and 60 at. % of titanium, between 0 and 69 at. % of palladium, between 1 and 40 at. % of gold, and the complement to 100 at. % includes a total comprised between 0 and 15 at. % of zirconium and hafnium, and one or more components from a sub-group of the first group composed of: Nb, V, Mo, Ta, W, Fe, Co, Ni, Ru, Rh, Ir, Pt, Cr, Mn, Cu, Zn, Ag, Al, Si, Ge, Sn, Sb, In.

In an alternative, the alloy includes a higher atomic percentage of palladium than gold.

More particularly, the alloy contains between 30 at. % and 60 at. % of titanium, and the rest of said alloy contains a majority of palladium and, in a quantity greater than 10 a. % of the total alloy, at least one metal from a second group including: Fe, Co, Ni, Ru, Rh, Ir, Au, Pt, Nb, V, Mo, Ta, W.

In another alternative, the alloy contains between 30 at. % and 60 at. % of titanium, and the rest of the alloy includes a majority of gold, and, in a quantity greater than 10 at. % of the total alloy, at least one metal from a second group including: Fe, Co, Ni, Ru, Rh, Ir, Au, Pt, Nb, V, Mo, Ta, W.

In a particular embodiment, the alloy includes at least one metal from a third group including: Cr, Mn, Cu, Zn and Ag, the overall quantity of said third group metals is less than 10 atomic percent of the total alloy.

In another particular embodiment, the alloy includes at least one metal from a fourth group including: Al, Si, Ge, Sn, Sb and In, the overall quantity of the fourth group metals is less than 4 atomic percent of the total alloy.

In a particular embodiment, the alloy includes between 49.0 and 51.0 at. % of titanium.

In another particular embodiment, the total atomic percentage of titanium, zirconium and hafnium is comprised between 49.0 and 51.0 at. %.

In the second composition set out above, the alloy conforms to the atomic composition $Ti_{a-x}(Zr,Hf)_xM_yPd_{1-a-y}$, with $0.3<a<0.6$; $0<x<0.05$; $0.01<y<0.4$.

In the third composition set out above, the alloy conforms to the atomic composition $Ti_{a-x}(Zr,Hf)_xM_yPd_z$, where $0.3<a<0.6$; $0<x<0.05$; $0.01<y<0.4$; $0.2<z<0.55$.

In the fourth composition set out above, the alloy conforms to the atomic composition $Ti_{a-x}(Zr,Hf)_xM_yPd_z$, where $0.44<a<0.55$; $0<x<0.05$; $0.07<y<0.28$; $0.25<z<0.45$.

More particularly, according to variants of this fourth composition:

- the alloy conforms to the atomic composition $Ti_rPd_sFe_t$, with r comprised between 49.5 and 50.5 at. %, s comprised between 31.5 and 32.5 at. %, t comprised between 17.5 and 18.5 at. %, where r+s+t=100. More particularly, the alloy conforms to the atomic composition $Ti_{0.50}Pd_{0.32}Fe_{0.18}$.
- the alloy conforms to the atomic composition $Ti_rPd_sNb_u$, with r comprised between 49.5 and 50.5 at. %, s comprised between 34.9 and 35.9 at. %, u comprised between 14.1 and 15.1 at. %, where r+s+u=100. More particularly, the alloy conforms to the atomic composition $Ti_{0.50}Pd_{0.354}Nb_{0.146}$.
- the alloy conforms to the atomic composition $Ti_rPd_sNb_u$, with r comprised between 49.2 and 50.2 at. %, s comprised between 37.3 and 40.3 at. %, u comprised between 10.0 and 13.0 at. %, where r+s+u=100, with variants according the ninth composition set out above:
- the alloy conforms to the atomic composition $Ti_rPd_sNb_u$, with r comprised between 49.2 and 50.2 at. %, s comprised between 37.3 and 38.3 at. %, u comprised between 12.0 and 13.0 at. %, where r+s+u=100. More particularly, the alloy conforms to the atomic composition $Ti_{0.497}Pd_{0.378}Nb_{0.125}$
- the alloy conforms to the atomic composition $Ti_rPd_sNb_u$, with r comprised between 49.2 and 50.2 at. %, s comprised between 39.3 and 40.3 at. %, u comprised between 10.0 and 11.0 at. %, where r+s+u=100. More particularly, the alloy conforms to the atomic composition $Ti_{0.497}Pd_{0.398}Nb_{0.105}$
- the alloy conforms to the atomic composition $Ti_rPd_sAu_v$, with r comprised between 49.5 and 50.5 at. %, s comprised between 39.9 and 40.9 at. %, v comprised between 8.5 and 9.5 at. %, where r+s+v=100. More particularly, the alloy conforms to the atomic composition $Ti_{0.50}Pd_{0.404}Au_{0.09}$.

the alloy conforms to the atomic composition $Ti_rPd_sCo_w$, with r comprised between 49.5 and 50.5 at. %, s comprised between 31.8 and 32.8 at. %, w comprised between 17.2 and 18.2 at. %, where r+s+w=100. More particularly, the alloy conforms to the atomic composition $Ti_{0.50}Pd_{0.323}Co_{0.177}$.

the alloy conforms to the atomic composition $Ti_rPd_sFe_cCr_d$, with r comprised between 49.5 and 50.5 at. %, s comprised between 31.5 and 32.5 at. %, c comprised between 16.5 and 17.5 at. %, d comprised between 0.5 and 1.5 at. %, where r+s+c+d=100. More particularly, the alloy conforms to the atomic corn position $Ti_{0.50}Pd_{0.32}Fe_{0.17}Cr_{0.01}$.

the alloy conforms to the atomic composition $Ti_rPd_sFe_cCr_d$, with r comprised between 49.2 and 50.2 at. %, s comprised between 31.4 and 32.5 at. %, c comprised between 9.9 and 15.8 at. %, d comprised between 2.5 and 8.5 at. %, with c+d comprised between 17.8 and 18.9 at. %, where r+s+c+d=100. According to variants described according to the eighth composition set out above:

the alloy conforms to the atomic composition $Ti_rPd_sFe_cCr_d$, with r comprised between 49.2 and 50.2 at. %, s comprised between 31.4 and 32.5 at. %, c comprised between 14.8 and 15.8 at. %, d comprised between 2.5 and 3.5 at. %, with c+d comprised between 17.8 and 18.9 at. %, where r+s+c+d=100. More particularly, the alloy conforms to the atomic composition $Ti_{0.497}Pd_{0.32}Fe_{0153}Cr_{0.03}$. According to other variants:

the alloy conforms to the atomic composition $Ti_rPd_sFe_cCr_d$, with r comprised between 49.2 and 50.2 at. %, s comprised between 31.4 and 32.5 at. %, c comprised between 11.8 and 12.8 at. %, d comprised between 5.5 and 6.5 at. %, with c+d comprised between 17.8 and 18.9 at. %, where r+s+c+d=100. More particularly, the alloy conforms to the atomic composition $Ti_{0.497}Pd_{0.32}Fe_{0.123}Cr_{0.06}$ the alloy conforms to the atomic composition $Ti_rPd_sFe_cCr_d$, with r comprised between 49.2 and 50.2 at. %, s comprised between 31.4 and 32.5 at. %, c comprised between 9.9 and 10.9 at. %, d comprised between 7.7 and 8.5 at. %, with c+d comprised between 17.8 and 18.9 at. %, where r+s+c+d=100. More particularly, the alloy conforms to the atomic composition $Ti_{0.497}Pd_{0.319}Fe_{0104}Cr_{0.08}$ the alloy conforms to the atomic composition $Ti_rPd_sFe_cCu_f$, with r comprised between 49.5 and 50.5 at. %, s comprised between 31.5 and 32.5 at. %, e comprised between 16.5 and 17.5 at. %, f comprised between 0.5 and 1.5 at. %, where r+s+e+f=100. More particularly, the alloy conforms to the atomic corn position $Ti_{0.50}Pd_{0.32}Fe_{0.17}Cu_{0.01}$.

the alloy conforms to the atomic composition $Ti_rPd_sFe_gZr_h$, with r comprised between 48.5 and 49.5 at. %, s comprised between 31.8 and 32.8 at. %, g comprised between 17.2 and 18.2 at. %, h comprised between 0.5 and 1.5 at. %, where r+s+g+h=100. More particularly, the alloy conforms to the atomic composition $Ti_{0.49}Zr_{0.01}Pd_{0.323}Fe_{0.177}$ the alloy conforms to the atomic composition $Ti_rPd_sFe_jAl_k$, with r comprised between 48.5 and 49.5 at. %, s comprised between 31.2 and 32.2 at. %, j comprised between 16.8 and 17.8 at. %, k comprised between 1.5 and 2.5 at. %, where r+s+j+k=100. More particularly, the alloy conforms to the atomic composition $Ti_{0.49}Pd_{0.317}Fe_{0.173}Al_{0.02}$.

the alloy conforms to the atomic composition $Ti_rPd_sFe_mNb_n$, with r comprised between 44.0 and 45.0 at. %, s comprised between 34.5 and 35.5 at. %, m comprised between 9.0 and 10.0 at. %, n comprised between 10.5 and 11.5 at. %, where r+s+m+n=100. More particularly, the alloy conforms to the atomic composition $Ti_{0.445}Pd_{0.35}Nb_{0.11}Fe_{0.095}$.

According to the fifth composition set out above, M includes one or more elements taken from a fifth group including: Nb, Mo, Fe, Cr, Mn, Cu, Zn, Ag, Al, Si, Ge, Sn, In.

According to the sixth composition set out above, M includes Fe and/or Nb as major elements.

According to the seventh composition set out above, the alloy contains 50% by mass of palladium. This mass percentage of the alloy is naturally not inconsistent with the atomic proportions of the alloying elements, it is an additional condition which is not at all incompatible.

The second family of alloys comprises compositions, utilising, in particular, three groups of metals (main group of metals and two sub-groups of metals) and five groups of traces (main group of traces and four sub-groups of traces). The following concerns this second family.

The invention concerns an external component 1 for a timepiece or piece of jewelry made of a light, precious alloy from this second family of alloys, containing titanium and palladium. This alloy conforms to the atomic formula $Ti_aPd_bM_cT_d$, where a, b, c, d are atomic fractions of the total, such that a+b+c+d=1, with:

comprised between 0.44 and 0.55 inclusive, b comprised between 0.30 and 0.45 inclusive, c comprised between 0.04 and 0.24 inclusive, d comprised between 0.001 and 0.03 inclusive, where the alloy includes at most two metals M, taken from a main group of metals composed of: Nb, V, Fe, Co, Au, Pt, the atomic fraction c being the sum of the atomic fractions of metals M, where the atomic fraction d is the sum of the atomic fractions of metal traces T, each metal trace T being taken with an atomic proportion of less than 3.0% of the total alloy, metal traces T being taken from a main group of traces including Nb, V Mo, Ta, W, Fe, Co, Ni, Ru, Rh, Ir, Au, Pt, Cr, Mn, Cu, Zn, Ag, Al, B, Si, Ge, Sn, Sb, In, with the exception of metals M incorporated in the alloy, which alloy includes at least 0.05% of boron in atomic fraction the atomic complement to 100% consisting of these at most two metals M, and where the alloy includes at least 50% by mass of palladium.

More particularly, the alloy contains, in atomic percent, less than 0.3% of boron.

In a particular composition with a reduced titanium range, these atomic fractions a, b, c, d are such that:

a is comprised between 0.48 and 0.52 inclusive, b is comprised between 0.30 and 0.43 inclusive, c is comprised between 0.05 and 0.21 inclusive, d is comprised between 0.001 and 0.03 inclusive.

In a variant wherein gold, platinum and cobalt are removed from the list of metals M, the at most two metals M are taken from a first sub-group of metals composed of: Nb, V, Fe, the atomic fraction c being the sum of the atomic fractions of metals M, and atomic fractions a, b, c, d are such that:

a is comprised between 0.49 and 0.51 inclusive,
b is comprised between 0.30 and 0.38 inclusive,
c is comprised between 0.09 and 0.20 inclusive,
d is comprised between 0.001 and 0.03 inclusive.

More particularly still, in the same variant without gold, platinum and cobalt, metal traces T are taken from a first sub-group of traces including Nb, V, Mo, Ta, W, Fe, Ni, Ru, Rh, Ir, Cr, Mn, Cu, Zn, Ag, Al, B, Si, Ge, Sn, Sb, In, with the exception of metals M incorporated in the alloy.

More particularly still, again in the same variant without gold, platinum or cobalt, metal traces T are taken from a second sub-group of traces including Nb, V, Fe, Ru, Rh, Au, Pt, Cr, B, with the exception of metals M incorporated in the alloy.

In the same variant without gold, platinum or cobalt, and without vanadium, these at most two metals M are taken from a second sub-group of metals composed of: Nb, Fe, the atomic fraction c being the sum of the atomic fractions of metals M, and atomic fractions a, b, c, d are such that:

a is comprised between 0.49 and 0.51 inclusive,
b is comprised between 0.30 and 0.38 inclusive,
c is comprised between 0.09 and 0.19 inclusive,
d is comprised between 0.001 and 0.03 inclusive.

In a sub-variant where the alloy contains a single metal M consisting of iron, the alloy conforms to the atomic formula $Ti_aPd_bFe_cT_d$, metal traces T are taken from a third sub-group of traces including Nb, V, Ru, Rh, Au, Pt, Cr, B, and atomic fractions a, b, c, d are such that:

a is comprised between 0.49 and 0.51 inclusive,
b is comprised between 0.31 and 0.35 inclusive,
c is comprised between 0.11 and 0.19 inclusive,
d is comprised between 0.001 and 0.03 inclusive.

More particularly, in this variant where the alloy contains a single metal M consisting of iron, the alloy contains at most two metal traces T taken from among chromium and boron, and atomic fractions a, b, c, d are such that:

a is comprised between 0.49 and 0.51 inclusive,
b is comprised between 0.31 and 0.33 inclusive,
c is comprised between 0.14 and 0.19 inclusive,
d is comprised between 0.010 and 0.030 inclusive.

More particularly still, the alloy contains a single metal trace T consisting of chromium, the alloy conforming to the atomic formula $Ti_aPd_bFe_cCr_d$.

In another sub-variant where the alloy contains a single metal M consisting of niobium, the alloy conforms to the atomic formula $Ti_aPd_bNb_cT_d$, metal traces T are taken from a fourth sub-group of traces including V, Fe, Ru, Rh, Au, Pt, Cr, B, and atomic fractions a, b, c, d are such that:

a is comprised between 0.49 and 0.51 inclusive,
b is comprised between 0.34 and 0.38 inclusive,
c is comprised between 0.09 and 0.16 inclusive,
d is comprised between 0.001 and 0.03 inclusive.

In a particular composition of this sub-variant where the alloy contains a single metal M consisting of niobium, the alloy includes at most two metal traces T taken from among chromium and boron, and atomic fractions a, b, c, d are such that:

a is comprised between 0.49 and 0.51 inclusive,
b is comprised between 0.34 and 0.36 inclusive,
c is comprised between 0.11 and 0.15 inclusive,
d is comprised between 0.010 and 0.030 inclusive.

In another composition of the same sub-variant where the alloy contains a single metal M consisting of niobium, the alloy contains a single metal trace T consisting of chromium, the alloy conforms to the atomic formula $Ti_aPd_bNb_cCr_d$, and atomic fractions a, b, c, d are such that:

a is comprised between 0.49 and 0.51 inclusive,
b is comprised between 0.34 and 0.36 inclusive,
c is comprised between 0.11 and 0.15 inclusive,
d is comprised between 0.010 and 0.030 inclusive.

For this entire second family of alloys, the palladium content can advantageously be reduced in order to reduce the cost of the alloy.

Thus, in a variant, the mass content of palladium is less than or equal to 60.0% of the total alloy.

More particularly, the mass content of palladium is less than or equal to 55.0% of the total alloy.

More particularly still, the mass content of palladium is less than or equal to 52.5% of the total alloy.

More particularly still, the mass content of palladium is less than or equal to 51.0% of the total alloy.

The invention also concerns a timepiece 10 or piece of jewelry, particularly a watch, including at least one such external component 1.

In short, for all compositions according to the invention, the various alloys selected above are ductile, and thus permit shaping using normal deformation processes.

These alloys are also:

precious, in the legal sense of the term (fineness);

particularly light compared to most precious alloys, in the legal sense of the term;

of no danger to the human body;

very resistant to corrosion.

The production of external timepiece components made of one of the aforecited alloys benefits from the optimisation of the alloy composition in different ways:

by adding elements that lower the melting point to facilitate implementation;

by modifying the content of precious metal replacement element to change the mechanical properties of the alloy;

by making various slight modifications to obtain alloys with structural hardening.

Selecting alloys with replacement components according to the invention can also obviate the shape memory effect observed in most of the basic alloys described. For example, the alloy $Ti_{0.5}Pd_{0.354}Nb_{0.146}$ has virtually no shape memory effect.

Numerous applications of the invention are possible, in particular but not limited to:

elements external to the movement: case middles, case backs, watch bezels, and outer parts (push-pieces, clasps, bracelets);

pieces of jewelry, components for movements and for internal watch parts.

The invention claimed is:

1. An external component comprising a light precious alloy comprising titanium and palladium, wherein the alloy has an atomic formula $Ti_aPd_bM_cT_d$, wherein:

a, b, c, d are atomic fractions of the total, such that a+b+c+d=1, a is between 0.44 and 0.55 inclusive,
b is between 0.30 and 0.45 inclusive,
c is between 0.04 and 0.24 inclusive,
d is between 0.001 and 0.03 inclusive, the alloy comprises at most two metals M selected from the group consisting of Nb, V, Fe, Co, Au, and Pt, wherein the atomic fraction c is the sum of the atomic fractions of the metals M, the atomic fraction d is the sum of the atomic fractions of trace metals T, wherein each trace metal T has an atomic proportion of less than 3.0% of the total alloy, and the trace metals T are selected from the group consisting of Nb, V, Mo, Ta, W, Fe, Co, Ni, Ru, Rh, Ir, Au, Pt, Cr, Mn, Cu, Zn, Ag, Al, B, Si, Ge, Sn, Sb, and In, with the exception of the metals M incorporated in the alloy, and the alloy comprises at least 0.05% in atomic fraction of boron, and wherein the alloy comprises 50% to 60% by mass of palladium.

2. The external component of claim 1, wherein the alloy comprises, in atomic percent, less than 0.3% of boron.

3. The external component of claim 1, wherein the atomic fractions a, b, c, d are such that:

a is between 0.48 and 0.52 inclusive, b is between 0.30 and 0.43 inclusive, c is between 0.05 and 0.21 inclusive, and d is between 0.001 and 0.03 inclusive.

4. The external component of claim 3, wherein:

the metals M are selected from the group consisting of Nb, V, and Fe, the atomic fraction c being the sum of the atomic fractions of the metals M, and wherein the atomic fractions a, b, c, d are such that:

a is between 0.49 and 0.51 inclusive, b is between 0.30 and 0.38 inclusive, c is between 0.09 and 0.20 inclusive, and d is between 0.001 and 0.03 inclusive.

5. The external component of claim 4, wherein the trace metals T are selected from the group consisting of Nb, V, Mo, Ta, W, Fe, Ni, Ru, Rh, Ir, Cr, Mn, Cu, Zn, Ag, Al, B, Si, Ge, Sn, Sb, and In, with the exception of the metals M incorporated in the alloy.

6. The external component of claim 4, wherein the trace metals T are selected from the group consisting of Nb, V, Fe, Ru, Rh, Au, Pt, Cr, and B, with the exception of the metals M incorporated in the alloy.

7. The external component of claim 6, wherein:

the metals M are selected from the group consisting of Nb and Fe, the atomic fraction c being the sum of the atomic fractions of the metals M, and wherein the atomic fractions a, b, c, d are such that:

a is between 0.49 and 0.51 inclusive, b is between 0.30 and 0.38 inclusive, c is between 0.09 and 0.19 inclusive, and d is between 0.001 and 0.03 inclusive.

8. The external component of claim 7, wherein:

the alloy comprises a single metal M consisting of iron, the alloy has an atomic formula $Ti_aPd_bFe_cT_d$, the trace metals T are selected from the group consisting of Nb, V, Ru, Rh, Au, Pt, Cr, and B, and the atomic fractions a, b, c, d are such that:

a is between 0.49 and 0.51 inclusive, b is between 0.31 and 0.35 inclusive, c is between 0.11 and 0.19 inclusive, and d is between 0.001 and 0.03 inclusive.

9. The external component of claim 8, wherein the alloy comprises at most two trace metals T selected from the group consisting of chromium and boron, and the atomic fractions a, b, c, d are such that:

a is between 0.49 and 0.51 inclusive, b is between 0.31 and 0.33 inclusive, c is between 0.14 and 0.19 inclusive, and d is between 0.010 and 0.030 inclusive.

10. The external component of claim 7, wherein:

the alloy comprises a single metal M consisting of niobium, the alloy has an atomic formula $Ti_aPd_bNb_cT_d$, the trace metals T are selected from the group consisting of V, Fe, Ru, Rh, Au, Pt, Cr, and B, and the atomic fractions a, b, c, d are such that:

a is between 0.49 and 0.51 inclusive, b is between 0.34 and 0.38 inclusive, c is between 0.09 and 0.16 inclusive, and d is between 0.001 and 0.03 inclusive.

11. The external component of claim 10, wherein the alloy comprises at most two trace metals T selected from the group consisting of chromium and boron, and the atomic fractions a, b, c, d are such that:

a is between 0.49 and 0.51 inclusive, b is between 0.34 and 0.36 inclusive, c is between 0.11 and 0.15 inclusive, and d is between 0.010 and 0.030 inclusive.

12. The external component of claim 1, wherein the mass content of palladium is less than or equal to 55.0% of the total alloy.

13. The external component of claim 1, wherein the mass content of palladium is less than or equal to 52.5% of the total alloy.

14. The external component of claim 1, wherein the mass content of palladium is less than or equal to 51.0% of the total alloy.

15. A timepiece or piece of jewelry comprising the external component of claim 1.

* * * * *